United States Patent [19]

Moudgil et al.

[11] 4,208,273

[45] Jun. 17, 1980

[54] SEPARATION OF COAL FROM WASTE MATERIAL

[75] Inventors: Brij M. Moudgil, Ontario; David F. Messenger, Pomona, both of Calif.

[73] Assignee: Occidental Research Corporation, La Verne, Calif.

[21] Appl. No.: 897,779

[22] Filed: Apr. 19, 1978

[51] Int. Cl.[2] ..... B07C 5/02

[52] U.S. Cl. ..... 209/3.3; 209/576

[58] Field of Search ..... 209/3.1, 3.2, 3.3, 1, 209/3, 4, 9, 578, 576

[56] References Cited

U.S. PATENT DOCUMENTS

| | | | |
|---|---|---|---|
| 1,678,884 | 7/1928 | Sweet | 209/3.1 |
| 2,967,614 | 1/1961 | Nury et al. | 209/3.1 |
| 3,346,111 | 10/1967 | Thompson et al. | 209/9 |
| 3,356,211 | 12/1967 | Mathews | 209/3.1 |
| 3,472,375 | 10/1969 | Mathews | 209/3.1 |
| 3,795,310 | 3/1974 | Buchot | 209/3.3 |
| 3,901,793 | 8/1975 | Buchot | 209/1 |
| 3,936,188 | 2/1974 | Sawyer | 209/3.1 |
| 3,992,287 | 11/1976 | Rhys | 209/2 |

*Primary Examiner*—Allen N. Knowles
*Attorney, Agent, or Firm*—Barry A. Bisson

[57] ABSTRACT

A method is disclosed for the separation of coal from run of mine (ROM) coal containing particles of coal and refuse, which comprises conditioning the ROM coal with a coupling agent capable of selectively coating the particulate coal to the substantial exclusion of coating the refuse, which coupling agent is at least one alcohol containing from about 6 to about 22 carbon atoms. Combined with said coupling agent is a fluorescent dye in a quantity to make the coated particles of coal fluoresce upon excitation to a degree sufficient to distinguish the coated coal particles from the substantially non-coated refuse. Exciting (e.g. as with ultraviolet light) the fluorescent dye coupled to the coal particles induces fluorescence and enables separating the fluorescing, coated coal particles from substantially non-fluorescing, non-coated refuse particles.

15 Claims, No Drawings

SEPARATION OF COAL FROM WASTE MATERIAL

BACKGROUND OF THE INVENTION

The present invention relates to a method for the separation of coal from ROM coal. More particularly, it relates to a method for separating coal from slate, shale, limestone, fireclay, and boney coal present in ROM coal.

As presently mined, ROM coal contains many impurities such as slate, shale, limestone, fireclay, and boney coal in varying concentrations. These and various other impurities in the ROM coal are hereinafter referred to as refuse. Separation of the coal from the refuse is generally required for about ⅔ of all the bituminous coal mined in the United States before the coal can be economically used in an environmentally acceptable manner. Separation of coal from the refuse has been conducted through techniques such as jigging, heavy media separation, shaking tables, and hydrocyclones. These techniques are based upon differences between the specific gravities of coal and the refuse. All of these techniques require large volumes of water to achieve desired separation. Gravity separation techniques are limited where large amounts of water are not available. Efficiency of separation of these techniques decreases as the specific gravities of the coal and refuse approach each other. For example, it is difficult to separate good coal from boney coal, as there is only a small difference between their specific gravities.

SUMMARY OF THE INVENTION

In accordance with the present invention, there is provided a method for the separation of higher BTU coal from ROM coal containing particles of higher BTU coal, lower BTU coal and refuse, which comprises conditioning the ROM coal (or any lower grade coal) with a coupling agent capable of selectively coating the particulate coal to the substantial exclusion of coating refuse, which coupling agent is at least one alcohol containing from about 6 to 22 carbon atoms. Also added, preferably combined with said coupling agent, is a fluorescent dye in a quantity to make the coated particles of coal fluoresce upon excitation to a degree sufficient to distinguish the higher grade coated coal particles from the lesser coated, lower grade coal particles and the substantially non-coated refuse. The fluorescent dye coupled to the coal particles is excited to induce fluorescence and the fluorescing, higher grade coated coal particles are separated from the substantially non-fluorescing, refuse particles and the lesser intensity fluorescing, lower grade coal particles.

As used herein, "higher grade" and "higher BTU" mean particles of economically significantly greater fuel value (or carbon, including hydrocarbon, content) as compared to "lower grade" or "lower BTU" coal or "refuse" (which has substantially no economic value as a fuel. It is to be understood that the distinction between higher and lower grade or BTU is a matter of economic choice. Once the economic choice (e.g. of a minimum BTU particle) is made, the sorting apparatus can be set to separate particles which possess a higher or lower fluorescent intensity than that chosen as the "cut-off point" corresponding to the intensity of a particle of the desired minimum BTU.

It should also be understood that the intensity cut-off point can be chosen so as to substantially separate refuse of substantially no fuel value from very low grade coal; however, the economic choice will more frequently be to separate higher BTU from lower BTU particles. For convenience, hereinafter, the process will be described as separation of refuse from ROM coal, but is intended to also describe to one of skill in the art how to separate higher from lower grade coal.

DETAILED DESCRIPTION OF THE INVENTION

According to the present invention, there is provided a method for the separation of refuse from ROM coal to recover coal therefrom. The practice of the method of this invention involves the separation of coal from the refuse present in the ROM coal. The ROM coal to be separated is conditioned with a coupling agent that will selectively coat the coal (or carbonaceous material) in a particle but will not coat the non-carbonaceous refuse. Combined with the coupling agent is a fluorescent dye that is capable of fluorescence when excited. The conditioned ROM coal is exposed to electromagnetic radiation to excite the fluorescent dye. The coated coal particles will fluoresce, whereupon they can be separated from the substantially non-coated, non-fluorescing refuse particles.

It should also be understood that a non-fluorescent dye or pigment which has a distinctive color in the visible range can be combined with the coupling agent, whereby the sorting can be done by eye or optical detection apparatus.

The method of the present invention is based upon the differences in surface chemical properties of the material present in ROM coal. Due to these differences, there can be utilized a coupling agent that will substantially, selectively coat only the carbonaceous coal present. By proper selection of coupling agent, the desirable coal in the ROM coal can be separated from the undesirable refuse. Surface chemical properties are relatively more consistent than other properties such as color, reflectance, or conductivity. These other properties tend to be similar for coal and refuse requiring a fine degree of resolution to distinguish between the coal and refuse. Such a degree of resolution is difficult to obtain and, therefore, the efficiency of separation based upon these properties suffers. Separation of material based upon the surface chemical properties is, therefore, more consistent than techniques based upon the above other properties.

To distinguish between the coupling agent coated coal and the non-coated material, there is incorporated with the coupling agent a tagging agent, such as a fluorescent dye. Following coating of the ROM coal with the coupling agent and dye, the ore can be radiated with electromagnetic radiation to cause the dye to fluoresce. The dye coupled with the coal by the coupling agent that is coating the coal will fluoresce to a substantial degree and the non-coated refuse material will essentially not fluoresce, thereby enabling the materials to be separated by differences in fluorescence.

Generally, fluorescence refers to the property of absorbing radiation at one particular wavelength and simultaneously re-emitting light of a different wavelength so long as the stimulus is active. It is intended in the present method to use the term fluorescence to indicate that property of absorbing radiation at one particular wavelength and re-emitting it at a different wavelength, whether or not visible, during exposure to an active stimulus or after exposure or during both these time periods. This, fluorescence is used generically herein to include fluorescence and phosphorescence, and envisions the emission of electromagnetic waves whether or not within the visible spectrum.

Electromagnetic radiation generally refers to the emission of energy waves of all the various wavelengths encompassed by the entire electromagnetic spectrum. It is intended in the present method to use the term electromagnetic radiation to indicate any and all stimuli that will excite and induce fluorescence of the fluorescent dye. Thus, electromagnetic radiation is used generically herein to include electromagnetic radiation and envisions other stimuli that will excite and induce fluorescence of the fluorescent dye.

The choice of a water-soluble or an oil-soluble dye is further described in Ser. No. 897,740 filed on the same day as the present application, of Brij M. Moudgil, titled "Separation of Limestone from Limestone Ore", (the entire disclosure of which is incorporated herein).

In general, if the coating on the coal (or carbonaceous material) is hydrophobic, an oil-soluble dye would be chosen to cause the coal to fluoresce; however, a water-soluble dye could be applied, which would preferentially coat the refuse in which case the higher grade coal would have a lower intensity and the refuse the higher fluorescence (or visible color). Similarly, if a coupling agent is used (e.g. a polyhydric alcohol) which produces a hydrophilic surface on the "carbon" of the coal, an oil-soluble dye (in an organic solvent) could be used to preferentially "color" the refuse or a water-soluble dye, in aqueous solution, could be used to preferentially color the carbonaceous material.

In practicing the present method in regard to ROM coal is, in general, first subjected to a crushing step. The ROM coal is crushed to physically separate the coal from the refuse present. Crushing increases the surface area of the particles and further provides a greater surface and reactive site for the coating of the particles by the coupling agent and fluorescent dye. In this crushing step, the ROM coal as mined is crushed to a particle size of from about ¼ to about 8 inches. It is preferred to crush the ROM coal in particle sizes of from about ½ to 3 inches. Particles less than ¼ inch and greater than 8 inches can be used in the practice of the method of this invention. However, the coating and separation of ore particles of less than ¼ inch is less economically attractive and ore particles of greater than 8 inches entrain impurities so as to make the separation process less efficient. Following the crushing and sizing process, the ROM coal can be deslimed to remove soluble impurities and surface fines on the particles.

Following the crushing and desliming steps, the ROM coal is conditioned with a coupling agent selected from an alcohol or mixture of alcohols containing from about 6 to about 22 carbon atoms. Preferably, the alcohol is monohydric, to produce a hydrophobic surface on the carbonaceous material in the particles. It is preferred to select at least one alcohol containing from about 8 to about 14 carbon atoms. Alcohols of more than about 22 carbon atoms tend to be less selective in coating only the coal particles. Therefore, since alcohols of more than about 22 carbon atoms are not as selective in coating the particles in the ROM coal, the efficiency of the separation decreases. Alcohols of less than about 6 carbon atoms will not generally remain on the coal particles.

Suitable alcohols useful as coupling agents in the practice of the method of the present invention include, but are not limited to: 1-hexanol, 1-decanol, 1-tetradecanol, 1-pentadecanol, 1-hexadecanol, 1-heptadecanol, 1-octadecanol, 1-nonadecanol, 1-eicosanol, 1-heneicosanol and 1-docosanol.

The coupling agent is combined with a marking agent, preferably a fluorescent dye, to distinguish coated particles from uncoated particles. Fluorescent dyes known to those skilled in the art and which are compatible with the coupling agents can be used in the practice of the method of this invention. Many such fluorescent dyes are commerically available, such as fluoranthene and fluorescent yellow G. (product of Morton Chemical, Chicago). It is preferred that the fluorescent dye be water-insoluble. Water-soluble fluorescent dyes can remain in the dispersant water used during the conditioning of the ore and can, therefore, be entrained in an aqueous surface coating on the refuse as well as combined with the coupling agent coating the coal. Thereby, the efficiency of distinguishing between the coal and refuse would be reduced. The preferred water-insoluble dyes remain combined with the coupling agent and are not attracted to the surface of the refuse particles.

The fluorescent dye can be combined with the coupling agent either before or after the ROM coal is conditioned with the coupling agent. The fluorescent dye can be used in any form, such as a solution, suspension, emulsion, dispersion or alone. The fluorescent dye can be combined with the coupling agent prior to conditioning the ROM coal by either mixing the fluorescent dye directly with the coupling agent or by mixing the fluorescent dye with a suitable diluent or solvent such as an oil, then mixing with the coupling agent. If the fluorescent dye is combined with the coupling agent following the alcohol-conditioning of the ROM coal, it can be applied directly to the conditioned ROM coal or it can be used in one of the above forms such as by mixing the dye with the diluent or solvent, then applying it to the conditioned ore. The fluorescent dye has an affinity toward the coupling agent coating and will, therefore, be attracted to and entrained substantially in only the coated coal particles. Any dye that adheres to the refuse particles, generally, is rinsed off through a wash of the ROM coal. It is preferred to combine the coupling agent and fluorescent dye prior to conditioning the ROM coal. Such prior treatment uses less flourescent dye, requires fewer steps and is generally more efficient both economically and in separation results.

To condition the ROM coal, the coupling agent is mixed with the sized ROM coal. The coupling agent can be dissolved in a suitable solvent, mixed with a dispersant such as water, or can be used alone. It is preferred to form a dispersion of the coupling agent in water. The aqueous dispersion is then contacted with the ROM coal. Many methods can be employed to contact the dispersion with the ROM coal. Such methods include, but are not limited to, spraying the dispersion onto the particles, passing the particles through a dispersion bath, and the like. It is preferred to spray the ROM coal particles with the dispersion of coupling agent in water. Such a spraying operation can consist of spraying the ROM coal particles as they pass on a belt or shaker bed. The ROM coal can also be passed through a ring sprayer or series of ring sprayers as in Ser. No. 897,946, filed concurrently herewith of Moudgil and Roeschlaub, titled "Method and Apparatus for Selective Wetting of Particles", the entire disclosure of which is hereby incorporated herein, to condition and coat the coal particles. The excess dispersion and that physically entrained in the particles can be washed from the ROM coal and used on a subsequent batch. Due to the surface chemical properties of the coal, the coupling agent selectively adheres to the coal and will coat the coal with a coating capable of fluorescence, which will allow the coal to be separated from the refuse present in the ROM coal.

Following the conditioning of the ROM coal, the ROM coal is exposed to electromagnetic radiation to cause the coating on the coal particles to fluoresce. The coated fluorescing particles can be separated from the substantially non-fluorescing particles by many different means, such as by hand or by an optical sorting device such as the Matthews' apparatus taught by Matthews' U.S. Pat. No. 3,472,375, incorporated herein by reference. In the Matthews' apparatus, a free-falling mixture of ore passes in front of a row of detectors. Each detector by proper attenuation is capable of distinguishing between non-fluorescence and fluorescence or in degree of fluorescence. Each detector in turn controls one flowing fluid stream selectively directed transverse to the path of the falling particle, the fluid stream being permitted to impinge only on the properly emitting ore particles. The directed fluid stream deflects the ore particles into a divergent path by which they are separated from the undesired ore particles. Such an apparatus is capable of detecting and separating the coupling agent and dye-coated particles from the non-coated particles.

The invention is further illustrated by the following examples, which are not intended to be limiting.

EXAMPLE 1

A quantity of crushed coal consisting of 83% by weight coal with an average particle size of from 1.5 to 2 inches was conditioned with a coupling agent of decyl alcohol coupled with fluoranthene. Fluoranthene fluorescent dye was dissolved in decyl alcohol. An aqueous dispersion of decyl alcohol, and fluoranthene dye, in water was made. The aqueous dispersion was sprayed onto the crushed and sized coal and refuse particles. The decyl alcohol coupling agent combined with fluoranthene selectively coated the carbonaceous matter or "coal" particles and was rejected by the non-carbonaceous matter or refuse particles. The excess aqueous dispersion was washed from the coal with a water wash.

The coated coal particles were separated from the non-coated refuse particles through the use of a Matthews' separator apparatus as shown in U.S. Pat. No. 3,472,375 by passing free-falling particles of the ore in front of a radiating source and subsequently fluorescence detectors. The coated coal particles fluoresced substantially to a greater degree than the refuse when radiated. Each detector had been attenuated to detect the degree of fluorescence of the coal particles and each controlled one flowing fluid steam selectively directed transverse to the path of the falling particles. The fluid streams impinged only on the fluorescing coal particles. The directed fluid stream deflected the fluorescing coal particles on a divergent path from the free-falling, substantially non-fluorescing refuse particles.

The fluorescing coal particles recovered consisted of 99% coal and accounted for 98% of the coal present in the initial feed material.

The initial feed material had an ash content of 17.3%, a total sulfur content of 0.52%, a pyritic sulfur content of 0.2%, and a BTU/lb rating of 11,339. The fluorescing coal particles separated by the method of this invention had an ash content of 5%, sulfur content of 0.47%, pyritic sulfur content of 0.1%, and a BTU/lb rating of 13,384.

There was a total BTU recovery from the upgraded coal of 96%. The rejected substantially non-fluorescing particles had an ash content of 71.1%, a sulfur content of 0.72%, a pyritic sulfur content of 0.6%, and a BTU/lb rating of 2,377.

EXAMPLE 2

The procedure of Example 1 was repeated in all essential details except the coupling agent used was decyl alcohol combined with the fluoranthene and fluorescent yellow G. The initial coal ore consisted of 88% by weight coal. The fluorescing coal particles recovered consisted of 99.5% coal and accounted for 92% of the coal present in the initial feed material.

The initial feed had an ash content of 19.4%, a sulfur content of 0.12%, a pyritic sulfur content of 0.45%, and a BTU/lb rating of 13,445. The fluorescing coal particles separated by the method of this invention had an ash content of 9.93%, a sulfur content of 0.07%, a pyritic sulfur content of 0.44%, and a BTU/lb rating of 15,138 for a BTU recovery of 91%. The substantially non-fluorescing refuse particles contained 59.64% ash, 0.27% sulfur, 0.50% pyritic sulfur, and had a BTU/lb rating of 6,155.

EXAMPLE 3

The procedure of Example 2 was repeated in all essential details except the initial feed material coal was of a particle size of from 1.5 to 2.5 inches and contained 75% by weight coal.

The fluorescing coal particles recovered consisted of 99% coal and accounted for 94% of the coal present in the initial ore.

The initial feed material consisted of 26.5% ash, 0.45% sulfur, 0.08% pyritic sulfur, and had a BTU/lb rating of 9,729. The fluorescing coal particles separated by the method of this invention consisted of 7.36% ash, 0.52% sulfur, 0.14% pyritic sulfur, and had a BTU/lb rating of 12,563 for a BTU recovery of 91%. The substantially non-fluorescing refuse particles contained 72.53% ash, 0.28% sulfur, 0.14% pyritic sulfur, and had a BTU/lb rating of 2,900.

EXAMPLE 4

The procedure of Example 2 was repeated in all essential details except the initial feed material was of a particle size of from 1.5 to 2.5 inches and contained 55% by weight coal.

The fluorescing coal particles recovered consisted of 91% coal and accounted for 98% of the coal present in the initial feed material.

The initial feed material consisted of 46.19% ash, 0.42% sulfur, 0.14% pyritic sulfur, and had a BTU/lb rating of 7,058. The fluorescing coal particles separated by the method of this invention consisted of 15.54% ash, 0.49% sulfur, 0.13% pyritic sulfur, and had a BTU/lb rating of 11,637 for a BTU recovery of 96%. The substantially non-fluorescing refuse particles contained 80.64% ash, 0.22% sulfur, 0.16% pyritic sulfur, and had a BTU/lb rating of 728.

EXAMPLE 5

The procedure of Example 1 is repeated in all essential details except the coupling agent is octanyl alcohol. The octanyl alcohol selectively coats the coal particles, but does not coat the refuse present in the coal ore.

The coated coal particles fluoresce when radiated with electromagnetic radiation. The fluorescing, coated coal particles are separated from the substantially non-fluorescing refuse particles.

EXAMPLE 6

The procedure of Example 1 is repeated in all essential details except the coupling agent is n-tetradecanol. The tetradecanol selectively coats the coal particles, but does not coat the refuse present in the coal ore.

The coated coal particles fluoresce when radiated with electromagnetic radiation. The fluorescing, coated coal particles are separated from the substantially non-fluorescing refuse particles.

EXAMPLE 7

The procedure of Example 1 is repeated in all essential details except eicosanyl alcohol is used as the coupling agent. The eicosanyl alcohol selectively coats the coal particles, but does not coat the refuse present in the coal ore.

The coated coal particles fluoresce when radiated with electromagnetic radiation. The fluorescing, coated coal particles are separated from the non-fluorescing refuse particles.

What is claimed is:

1. A process for the separation of coal from a run of mine (ROM) coal containing particles of carbonaceous coal and refuse which comprises conditioning the ROM coal with a coupling agent capable of selectively coating carbonaceous coal in the particulate ROM coal to the substantial exclusion of coating refuse, which coupling agent comprises at least one alcohol containing from about 6 to about 22 carbon atoms and which coupling agent is combined with a fluorescent dye in a quantity sufficient to make the coated particles of carbonaceous coal fluoresce upon excitation to a degree sufficient to distinguish the coated carbonaceous coal particles from the substantially non-coated refuse, exciting the fluorescent dye coupled to the carbonaceous coal particles to induce fluorescence; and separating fluorescing, coated carbonaceous coal particles from substantially non-fluorescing, non-coated refuse particles.

2. The process of claim 1 wherein said coupling agent comprises an alcohol having from about 8 to about 14 carbon atoms.

3. The process of claim 1 wherein said coupling agent comprises n-decyl alcohol.

4. The process of claim 1 wherein said coupling agent comprises n-octanyl alcohol.

5. The process of claim 1 wherein said coupling agent comprises n-tetradecanol.

6. The process of claim 1 wherein said coupling agent comprises n-eicosanyl alcohol.

7. The process of claim 1 wherein said fluorescent dye comprises an oil soluble dye.

8. The process of claim 7 wherein said fluorescent dye comprises fluoranthene.

9. The process of claim 7 wherein said fluorescent dye comprises fluorescent yellow G.

10. The process of claim 1 wherein said fluorescent dye is combined with the coupling agent prior to the conditioning of the ROM coal.

11. The process of claim 1 wherein said fluorescent dye is combined with the coupling agent after the ROM coal has been conditioned with said coupling agent.

12. The process of claim 1 wherein said ROM coal is of a particle size of from about ¼ inch to about 8 inches.

13. The process of claim 12 wherein said ROM coal is of a particle size of from about ½ inch to about 3 inches.

14. A process for separating coal particles from ROM coal containing particles and refuse particles, comprising treating particulate ROM coal with a detectable marking agent to attach said marking agent preferentially to the coal particles or refuse particles in said ROM coal, and by thereafter separating particles carrying said marking agent from the treated particulate ROM coal.

15. A process for separating coal particles from ROM coal containing coal particles and refuse particles, comprising treating particulate ROM coal with a coating agent comprising at least one alcohol containing from about 6 to about 22 carbon atoms preferentially to coat coal particles, and with a detectable marking agent to attach said marking agent to the coal particles or refuse particles in said ROM coal, and thereafter separating particles carrying said marking agent from the treated particulate ROM coal.

* * * * *